US009353911B2

(12) United States Patent
Takahashi et al.

(10) Patent No.: US 9,353,911 B2
(45) Date of Patent: May 31, 2016

(54) BLANKET INSTALLATION METHOD

(75) Inventors: Masaki Takahashi, Tokyo (JP); Hidenori Suzuki, Tokyo (JP); Satoru Nagumo, Tokyo (JP); Akira Iwano, Tokyo (JP)

(73) Assignee: IHI CORPORATION (JP)

( * ) Notice: Subject to any disclaimer, the term of this patent is extended or adjusted under 35 U.S.C. 154(b) by 268 days.

(21) Appl. No.: 13/881,885

(22) PCT Filed: Nov. 11, 2011

(86) PCT No.: PCT/JP2011/076060

§ 371 (c)(1),
(2), (4) Date: Jun. 3, 2013

(87) PCT Pub. No.: WO2012/063937

PCT Pub. Date: May 18, 2012

(65) Prior Publication Data

US 2013/0255059 A1 Oct. 3, 2013

(30) Foreign Application Priority Data

Nov. 11, 2010 (JP) ..... 2010-252895

(51) Int. Cl.
*F17C 3/02* (2006.01)
*F17C 3/04* (2006.01)

(52) U.S. Cl.
CPC . *F17C 3/04* (2013.01); *F17C 3/022* (2013.01); *F17C 3/025* (2013.01); *F17C 2201/0104* (2013.01); *F17C 2201/032* (2013.01); *F17C 2201/052* (2013.01); *F17C 2203/0304* (2013.01); *F17C 2203/035* (2013.01); *F17C 2203/0341* (2013.01); *F17C 2203/0629* (2013.01); *F17C 2209/238* (2013.01); *F17C 2221/033* (2013.01);
(Continued)

(58) Field of Classification Search
CPC ..... F17C 3/04; F17C 3/025; F17C 3/022; F17C 2201/052; F17C 2209/238; F17C 2201/032; F17C 2201/0104; F17C 2203/035; F17C 2260/013; F17C 2203/0304; Y10T 29/49826
See application file for complete search history.

(56) References Cited

U.S. PATENT DOCUMENTS 3,481,504 A 12/1969 Nelson
3,861,021 A * 1/1975 Yamamoto ..... 29/455.1
(Continued)

FOREIGN PATENT DOCUMENTS

GB 1498042 1/1978
JP B-53-016123 5/1978
(Continued)

OTHER PUBLICATIONS

JPS59-231297 English Machine Translation of Abstract.*
(Continued)

*Primary Examiner* — Sarang Afzali
*Assistant Examiner* — Ruth G Hidalgo-Hernande
(74) *Attorney, Agent, or Firm* — Ostrolenk Faber LLP

(57) ABSTRACT

Provided is a blanket installation method, which includes a transporting step of transporting a blanket unit (1), in which the blanket (2) and a transport jig (3) are coupled in one body, between an inner tank (60) and an outer tank in a double shell tank, in a suspended condition, and a mounting step of mounting the blanket unit on a shell plate of the inner tank. According to the method, in the event of installing work of the blanket, the improvement in work efficiency and safety can be achieved.

4 Claims, 8 Drawing Sheets

(52) U.S. Cl.
CPC ... *F17C 2223/0161* (2013.01); *F17C 2223/033* (2013.01); *F17C 2260/013* (2013.01); *F17C 2270/0105* (2013.01); *F17C 2270/0136* (2013.01); *Y10T 29/49826* (2015.01)

(56) References Cited

U.S. PATENT DOCUMENTS

| | | | | |
|---|---|---|---|---|
| 3,935,957 | A * | 2/1976 | Hasegawa | 220/560.1 |
| 3,987,925 | A * | 10/1976 | Sattelberg | 220/560.08 |
| 4,207,827 | A * | 6/1980 | Gondouin | 114/74 A |
| 4,327,554 | A * | 5/1982 | Patil et al. | 62/45.1 |
| 2005/0053692 | A1 * | 3/2005 | Eichlseder | 425/563 |

FOREIGN PATENT DOCUMENTS

| | | |
|---|---|---|
| JP | A-55-020922 | 2/1980 |
| JP | 58-094694 | 6/1983 |
| JP | U-59-021199 | 2/1984 |
| JP | 59-231297 | 12/1984 |
| JP | 60-173796 | 11/1985 |
| JP | 61-165097 | 7/1986 |
| JP | 63-009748 | 3/1988 |
| JP | 63-029994 | 8/1988 |
| JP | 63-056385 | 11/1988 |
| JP | 3-181698 | 8/1991 |
| JP | 8-121695 | 5/1996 |
| JP | 2002-070312 | 3/2002 |
| JP | 2003-227596 | 8/2003 |
| JP | 2004-043076 | 2/2004 |

OTHER PUBLICATIONS

Notice of Reasons for Rejection mailed Feb. 4, 2014 in corresponding Japanese Patent Application No. 2012-542988 (with English language translation).

International Search Report and Written Opinion mailed Jan. 31, 2012 in corresponding PCT International Application No. PCT/JP2011/076060.

* cited by examiner

BLANKET INSTALLATION METHOD

CROSS-REFERENCE TO RELATED APPLICATIONS

The present application is a 35 U.S.C. §§371 national phase conversion of PCT/JP2011/076060, filed Nov. 11, 2011, which claims priority to Japanese Patent Application No. 2010-252895, filed Nov. 11, 2010, the contents of which are incorporated herein by reference. The PCT International Application was published in the Japanese language.

TECHNICAL FIELD

The present invention relates to a blanket installation method.

BACKGROUND ART

Conventionally, as a tank storing a cryogenic liquid such as liquefied natural gas (LNG), a double shell tank made up of an outer tank and an inner tank is known. In this double shell tank, a space between the outer tank and the inner tank is filled with granular perlite as a cold insulation material, and thus a cold insulation layer is formed (see Patent Document 1 below). Further, a resilient blanket (hereinafter abbreviated to "blanket") for preventing the inner tank from being deformed by a pressure difference between an exterior (cold insulation layer) and an interior of the inner tank is installed on a shell plate (outer wall) of the inner tank.

CITATION LIST

Patent Documents

Patent Document 1: Japanese Unexamined Patent Application, First Publication No. S61-165097

SUMMARY OF INVENTION

Technical Problem

Conventionally, after the outer tank and the inner tank are assembled, a plurality of anchor pins are mounted on the shell plate of the inner tank, and the blanket is thrust into and fixed to these anchor pins. However, during fixing of the blanket, the anchor pins may be broken or fall off. Thus, repair work occurs frequently, causing a decrease in work efficiency. Further, since there is a need to mount the anchor pins having a length of about 0.3 to 0.4 m in a narrow space of about 1.0 to 1.2 m between the inner and outer tanks, a problem that, during the mounting work, the anchor pins are damaged, or special attention is required in view of safety may occur.

The present invention has been made in consideration of these circumstances, and an object of the present invention is to achieve the improvement in work efficiency and safety in the event of installing work of a blanket.

Solution to Problem

To accomplish the above object, as a first aspect according to a blanket installation method in the present invention, there is provided a blanket installation method, which includes a transporting step of transporting a blanket unit, in which the blanket and a transport jig are coupled in one body, between an inner tank and an outer tank in a double shell tank, in a suspended condition, and a mounting step of mounting the blanket unit on a shell plate of the inner tank.

Further, as a second aspect according to the method of installing the blanket in the present invention, in the first aspect, the blanket may be pinned to the transport jig.

In the second aspect, the transport jig may include a strap extending in a vertical direction when the blanket unit is installed between the inner tank and the outer tank, and a blanket fixing pin installed on the strap. In this case, the blanket is pinned to the transport jig by pressing the blanket fixing pin into the blanket with the blanket facing the strap.

Further, as a third aspect according to the method of installing the blanket in the present invention, in the first or second aspect, the blanket unit may be transported in the suspended condition by hooking a hook on a transporting bolt installed on the blanket unit.

Further, as a fourth aspect according to the method of installing the blanket in the present invention, in any one of the first to third aspects, the blanket unit may be mounted on the shell plate of the inner tank by inserting an anchor rod previously fixed to the shell plate of the inner tank through the blanket unit and by fastening the anchor rod with a nut.

Advantageous Effects of Invention

According to the method of installing the blanket in accordance with the present invention, there is no need to mount the anchor pins on the shell plate of the inner tank as in the related art. For this reason, no problem with damage and safety of the anchor pins in the event of the installing work of the blanket occurs, and the improvement in work efficiency and safety can be achieved.

DESCRIPTION OF EMBODIMENTS

Hereinafter, an embodiment of the present invention will be described with reference to the drawings.

First, referring to FIGS. 1 to 2B, an assembling method of a blanket unit 1 in the present embodiment will be described. To transport a glass wool blanket 2, which is weak in tensile strength and is easily fractured by its own weight, in a hooked condition, the blanket unit 1 is configured by integrally coupling the blanket 2 and a transport jig 3 for transporting the blanket 2.

Figure 1A:
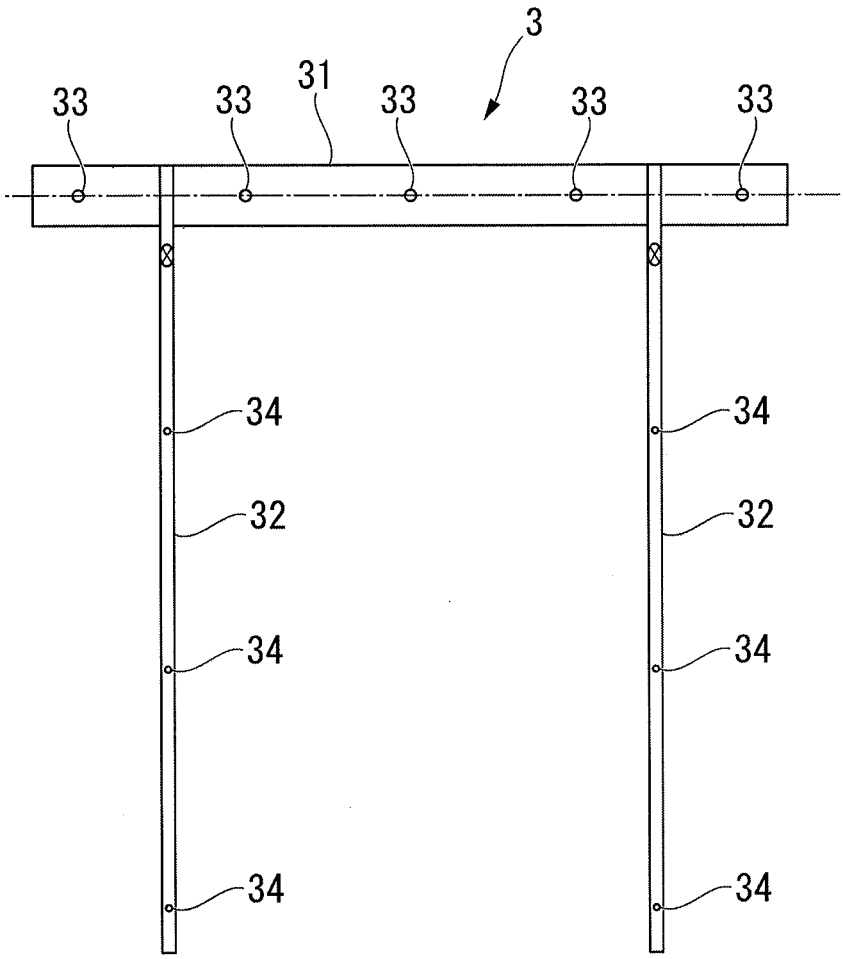
FIG. 1A is a plan view of a transport jig constituting a blanket unit in an embodiment before the blanket unit is assembled.

FIG. 1A is a plan view of the transport jig 3 constituting the blanket unit 1. As shown in this figure, the transport jig 3 is made up of an aluminum support plate 31 having a rectangular shape and band-shaped stainless steel sheets (hereinafter referred to as "straps") 32 one of which is connected to each of opposite sides of the support plate 31. A plurality of transporting bolts 33 are inserted through the support plate 31 at regular intervals. Further, a plurality of blanket fixing pins 34 are stud-welded to each strap 32 at regular intervals.

Figure 1B:
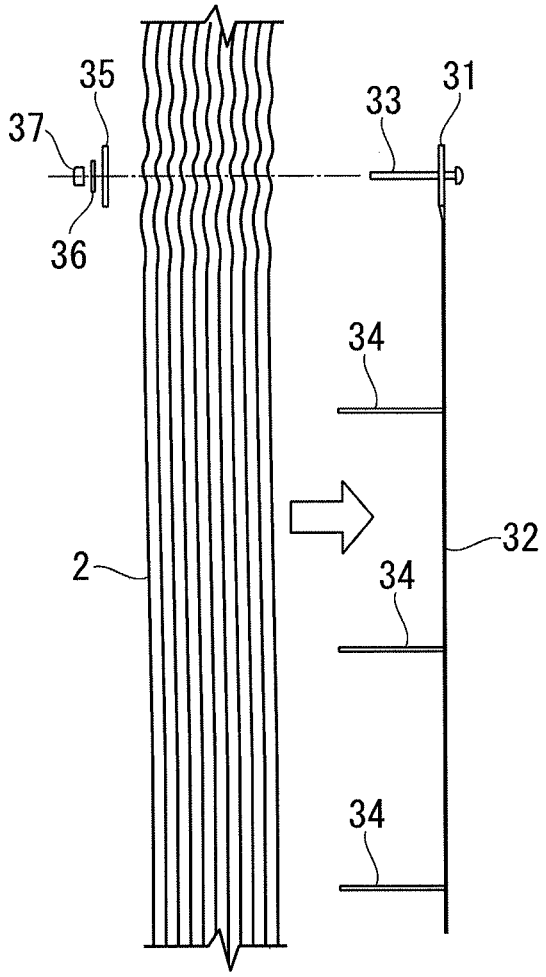
FIG. 1B illustrates a method of assembling the blanket unit in the embodiment.
Figure 1C:
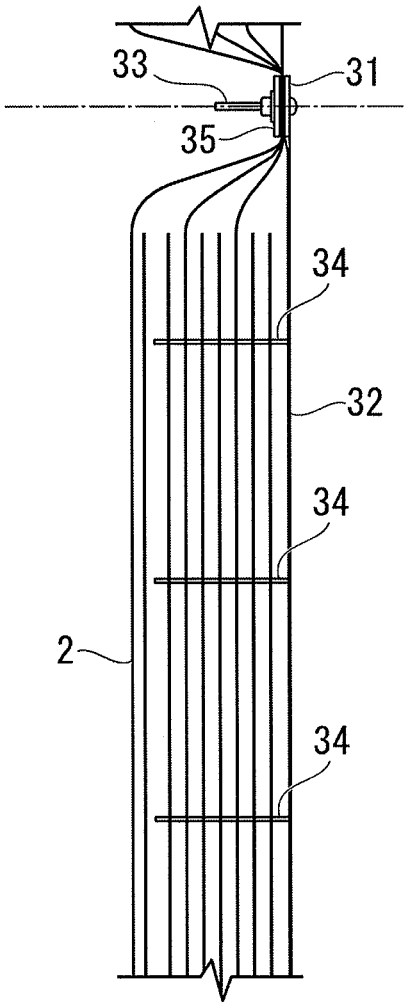
FIG. 1C illustrates the method of assembling the blanket unit in the embodiment.

As shown in FIG. 1B, the blanket 2 is pressed to the transport jig 3 in a face-to-face condition. Thereby, the transporting bolts 33 and the blanket fixing pins 34 of the transport jig 3 pierce the blanket 2. Thus, as shown in FIG. 1C, a support plate 35 having the same shape as the support plate 31 is disposed opposite to the support plate 31 with the blanket 2 sandwiched therebetween, and is pressed to the support plate 31. Thereby, the transporting bolts 33 are inserted through the support plate 35 while compressing the blanket 2. Further, the transporting bolts 33 are fastened from the side of the support plate 35 using washers 36 and nuts 37. Thereby, the support plates 31 and 35 are fixed with the blanket 2 sandwiched therebetween.

Figure 2A:
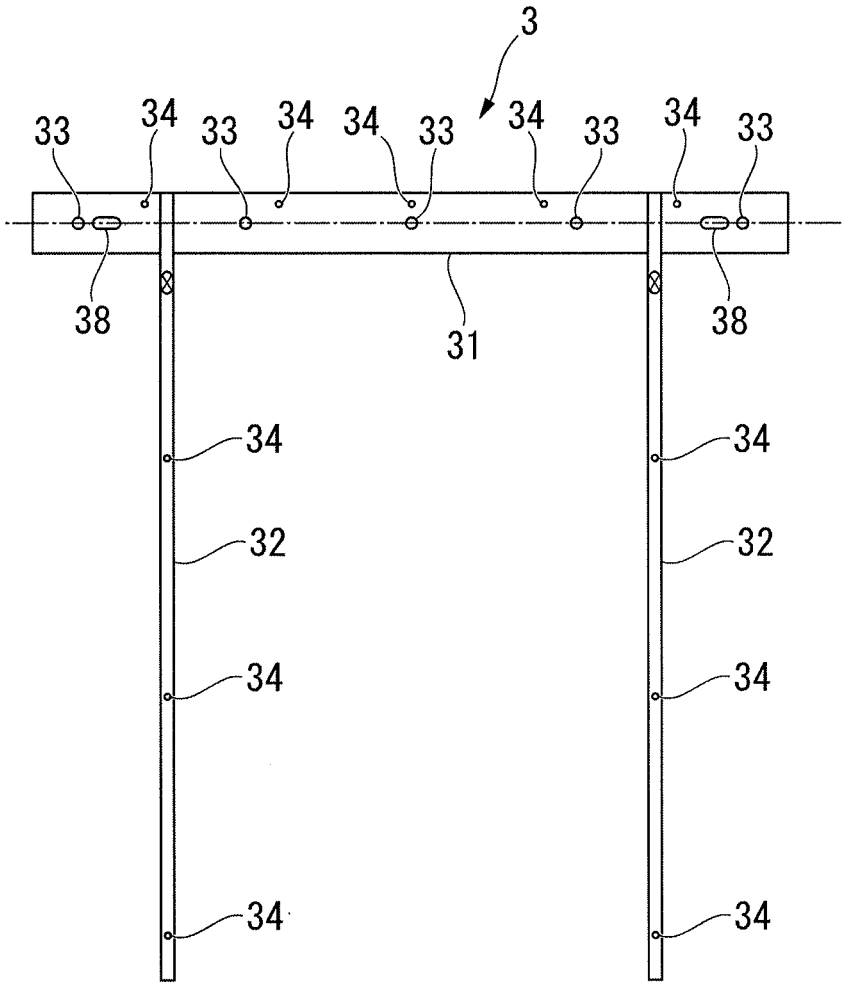
FIG. 2A is a plan view of the transport jig constituting the blanket unit in the embodiment when the blanket unit is assembled.
Figure 2B:
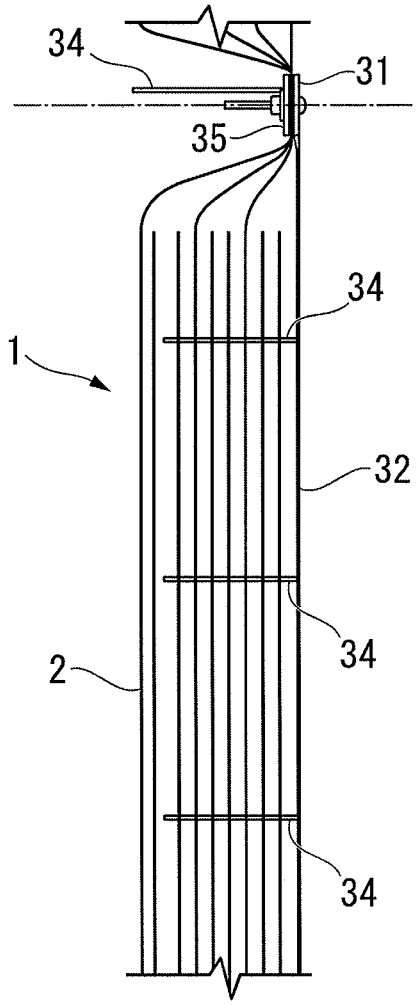
FIG. 2B illustrates the method of assembling the blanket unit 1 in the embodiment.

Finally, as shown in FIGS. 2A and 2B, after the plurality of blanket fixing pins 34 are stud-welded to a surface of the support plate 35 at regular intervals, two through-holes 38 penetrating from the support plate 35 to the support plate 31 are provided at both sides of the support plate 35. Thereby, the blanket unit 1 in which the blanket 2 and the transport jig 3 are coupled in one body is finished. The assembly of this blanket unit 1 may be performed at a flat place in the field (construction site of a double shell tank) or at a workshop.

Figure 3:
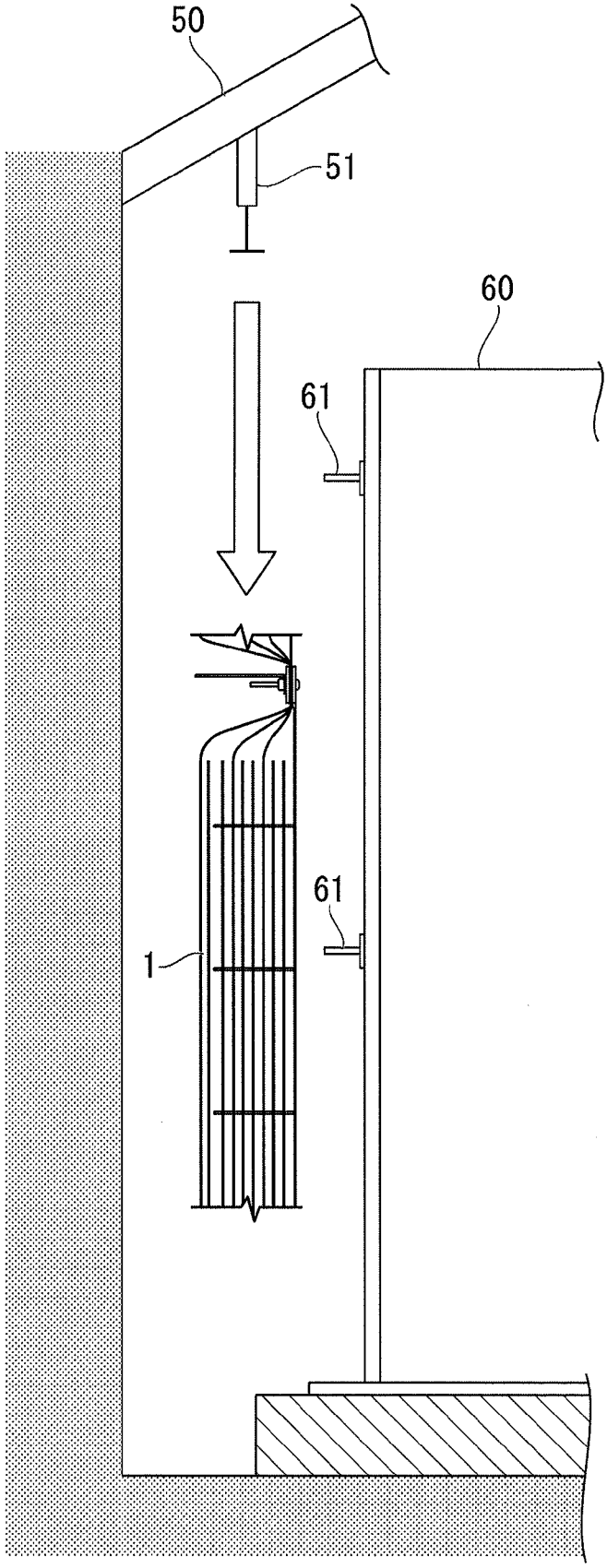
FIG. 3 illustrates a blanket installation method in the embodiment.

Next, a method of installing the blanket in the present embodiment will be described with reference to FIGS. 3 to 4B. In FIG. 3, a reference numeral 50 indicates an outer tank of the double shell tank, a reference numeral 51 indicates a working crane installed on a roof of the outer tank 50, a reference numeral 60 indicates an inner tank of the double shell tank, and a reference numeral 61 indicates an anchor rod previously stud-welded to a shell plate of the inner tank 60. A plurality of anchor rods 61 are mounted in circumferential and height directions of the shell plate of the inner tank 60 at regular intervals.

First, as shown in FIG. 3, the previously-assembled blanket unit 1 is transported between the outer tank 50 and the inner tank 60 in a suspended condition using the working crane 51 (transporting step). Here, the blanket unit 1 can be easily transported in the suspended condition by simply hooking a hook of the working crane 51 on the transporting bolts 33 of the blanket unit 1. Further, since the blanket 2 is pinned to the transport jig 3 by the blanket fixing pins 34 installed on the straps 32, the blanket 2 is not fractured by its own weight even when transported in the suspended condition.

Figure 4A:
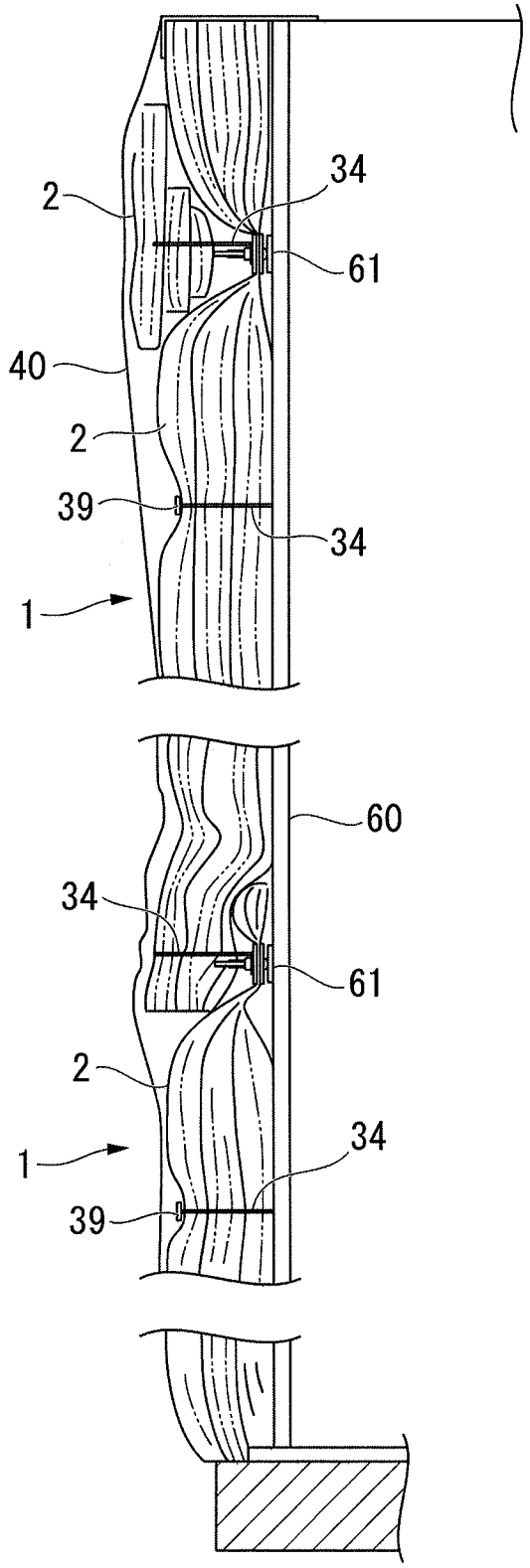
FIG. 4A illustrates the method of installing the blanket in the embodiment.

Thus, after the anchor rods 61 are inserted through the through-holes 38 of the blanket unit 1, the anchor rods 61 are fastened with nuts. Thereby, the blanket unit 1 is mounted on the shell plate of the inner tank 60 (mounting step). After the mounting work of the blanket unit 1 is performed from a lower side of the inner tank 60, and is completed at the lower side, the mounting work is performed at an upper side. FIGS. 4A and 4B show a state in which the blanket unit 1 is mounted on the shell plate of the inner tank 60.

Figure 4B:
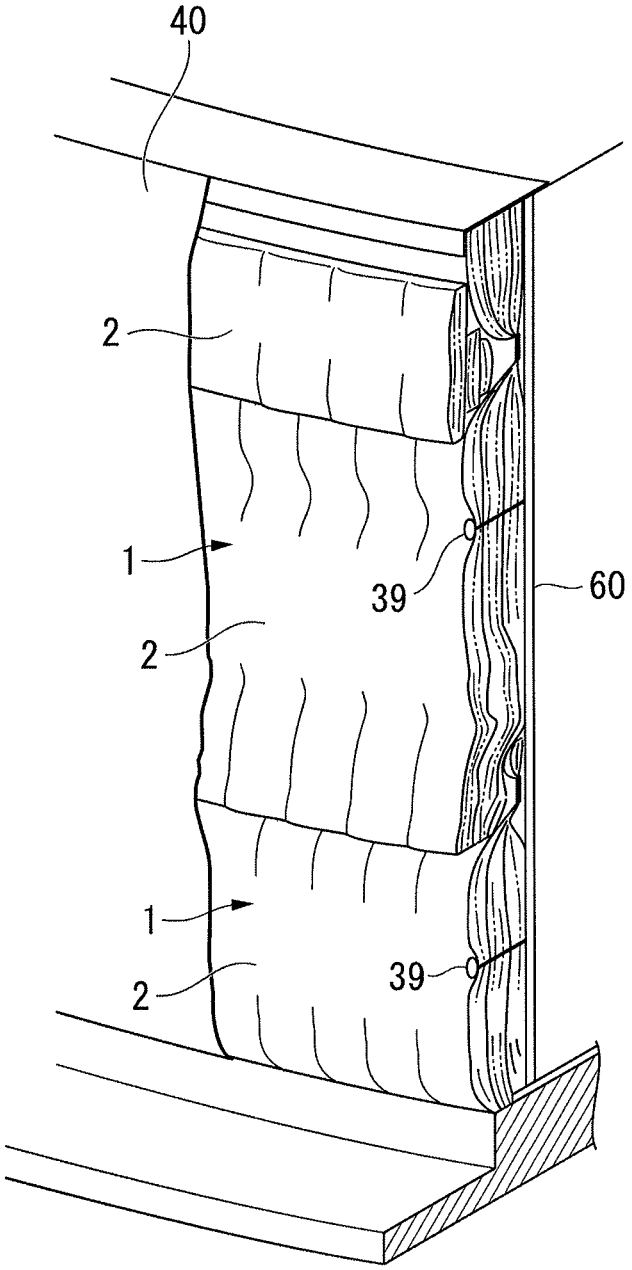
FIG. 4B illustrates the method of installing the blanket in the embodiment.

As shown in FIGS. 4A and 4B, after the blanket unit 1 is mounted on each anchor rod 61, the washers 39 are disposed on tips of the blanket fixing pins 34 installed on the straps 32 of each blanket unit 1. Thereby, each blanket 2 is fastened to the straps 32. Further, a lower end portion of the blanket 2 in the upper blanket unit 1 is pierced and fixed to the blanket fixing pins 34 installed on the support plate 35 in the lower blanket unit 1.

An upper end portion of the blanket 2 in the upper blanket unit 1 is adhered to an upper portion of the inner tank 60 using an adhesive or the like. Further, the blanket 2 suspended from the upper portion of the inner tank 60 is pierced and fixed to the blanket fixing pins 34 installed on the support plate 35 in the upper blanket unit 1. Finally, each blanket unit 1 is covered with a cover member 40. Thereby, the installing work of the blanket 2 is completed.

As described above, according to the method of installing the blanket in the present embodiment, in the process of assembling the blanket unit 1 prior to the installing work of the blanket, the fixing work of the blanket 2 using the blanket fixing pins 34 is completed. For this reason, during the installing work of the blanket, there is no possibility of the blanket fixing pins 34 being damaged. As a result, the repair work is not required, and the work efficiency is improved. Further, since there is no need to perform the mounting work of the blanket fixing pins 34 in the narrow space between the inner and outer tanks as in the related art, the safety is also improved.

Naturally, the present invention is not limited to the above embodiment, and may be modified without departing from the spirit of the present invention. For example, in the above embodiment, the transport jig 3 having the configuration as shown in FIG. 1 is illustrated. However, the configuration of the transport jig 3 is not limited to this, and another configuration may be employed as long as the transport jig 3 is able to transport the blanket 2, which is easily fractured by its own weight, in the suspended condition.

Further, in the above embodiment, the case in which two blanket units 1 are installed on the shell plate of the inner tank 60 in up-and-down stages is illustrated. However, the present invention is not limited to this, and one blanket unit 1 may be installed, or three or more blanket units 1 are installed in up-and-down stages according to the restrictions of assembly and transportation of the unit.

INDUSTRIAL APPLICABILITY

According to the present invention, in the event of the installing work of the blanket between the inner and outer tanks of the double shell tank, the improvement in work efficiency and safety can be achieved.

REFERENCE SIGNS LIST

1: blanket unit
2: blanket
3: transport jig
31, 35: support plate
32: strap
33: transporting bolt
34: blanket fixing pin
50: outer tank
51: working crane
60: inner tank
61: anchor bolt

The invention claimed is:

1. A blanket installation method comprising:

a transporting step of transporting a blanket unit, in which the blanket and a transport jig are coupled in one body, between an inner tank and an outer tank in a double shell tank, in a suspended condition; and a mounting step of mounting the blanket unit on a shell plate of the inner tank, wherein the transport jig includes a strap which is band-shaped and extending in a vertical direction when the blanket unit is installed between the inner tank and the outer tank, and a plurality of blanket fixing pins fixed to a surface of the strap at regular intervals so as to extend perpendicular to the surface of the strap, and the blanket is pinned to the transport jig by pressing the blanket fixing pin into the blanket with the blanket facing the strap.

2. The method according to claim 1, wherein the blanket unit is transported in the suspended condition by hooking a hook on a transporting bolt installed on the blanket unit.

3. The method according to claim 2, wherein the blanket unit is mounted on the shell plate of the inner tank by inserting an anchor rod previously fixed to the shell plate of the inner tank through the blanket unit and by fastening the anchor rod with a nut.

4. The method according to claim 1, wherein the blanket unit is mounted on the shell plate of the inner tank by inserting an anchor rod previously fixed to the shell plate of the inner tank through the blanket unit and by fastening the anchor rod with a nut.

* * * * *